US010036222B2

(12) United States Patent
Purohit et al.

(10) Patent No.: US 10,036,222 B2
(45) Date of Patent: Jul. 31, 2018

(54) BOTTOM HOLE ASSEMBLY RETRIEVAL FOR CASING-WHILE-DRILLING OPERATIONS USING A TETHERED FLOAT VALVE

(71) Applicant: Halliburton Energy Services, Inc, Houston, TX (US)

(72) Inventors: Ankit Purohit, Pune (IN); Anand Bhagwat Kedare, Pune (IN); Bhargav Gajji, Pune (IN); Sanjay Sawant, Pune (IN)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 15/261,209

(22) Filed: Sep. 9, 2016

(65) Prior Publication Data

US 2017/0067298 A1 Mar. 9, 2017

Related U.S. Application Data

(63) Continuation of application No. 14/383,309, filed as application No. PCT/US2013/075027 on Dec. 13, 2013, now Pat. No. 9,464,483.

(51) Int. Cl.

| | |
|---|---|
| ***E21B 23/14*** | (2006.01) |
| ***E21B 34/10*** | (2006.01) |
| ***E21B 7/20*** | (2006.01) |
| ***E21B 17/02*** | (2006.01) |
| ***E21B 21/10*** | (2006.01) |
| ***E21B 23/00*** | (2006.01) |
| ***E21B 23/04*** | (2006.01) |
| ***E21B 10/64*** | (2006.01) |

(52) U.S. Cl.

CPC ..... *E21B 23/14* (2013.01); *E21B 7/20* (2013.01); *E21B 10/64* (2013.01); *E21B 17/02* (2013.01); *E21B 21/10* (2013.01); *E21B 23/00* (2013.01); *E21B 23/04* (2013.01); *E21B 34/10* (2013.01)

(58) Field of Classification Search

CPC ..... E21B 17/06; E21B 34/10; E21B 43/10; E21B 21/10; E21B 17/02; E21B 7/20; E21B 23/04; E21B 10/64; E21B 23/14; E21B 23/00

See application file for complete search history.

(56) References Cited

U.S. PATENT DOCUMENTS

| | | | | |
|---|---|---|---|---|
| 3,552,509 A | | 1/1971 | Brown | |
| 3,661,218 A | | 5/1972 | Brown | |
| 3,945,444 A | * | 3/1976 | Knudson | E21B 4/06 175/171 |
| 4,519,457 A | | 5/1985 | Holland et al. | |
| 4,708,208 A | | 11/1987 | Halbardier | |
| 5,168,942 A | | 12/1992 | Wydrinski | |

(Continued)

OTHER PUBLICATIONS

International Search Report and The Written Opinion of the International Searching Authority, or the Declaration, dated Apr. 29, 2014, PCT/US2013/075027, 7 pages, ISA/US.

(Continued)

*Primary Examiner* — Michael R Wills, III

(57) ABSTRACT

A bottom hole assembly for a casing-while-drilling operation utilizes a tethered float valve to retrieve the bottom hole assembly after the casing string has been positioned at a desired wellbore depth.

19 Claims, 6 Drawing Sheets

(56) References Cited

U.S. PATENT DOCUMENTS

| | | | | |
|---|---|---|---|---|
| 5,271,472 | A | 12/1993 | Leturno | |
| 6,722,451 | B2 | 4/2004 | Saugier | |
| 6,877,570 | B2 | 4/2005 | Chen et al. | |
| 7,086,485 | B2 | 8/2006 | Moriarty et al. | |
| 7,108,084 | B2 * | 9/2006 | Vail, III | E21B 7/065 175/257 |
| 7,182,153 | B2 | 2/2007 | Moriarty | |
| 7,475,742 | B2 | 1/2009 | Angman et al. | |
| 7,481,280 | B2 | 1/2009 | Benge et al. | |
| 7,513,300 | B2 | 4/2009 | Pietras et al. | |
| 7,845,431 | B2 | 12/2010 | Eriksen et al. | |
| 8,443,906 | B2 * | 5/2013 | Tessari | E21B 10/64 166/377 |
| 2002/0070027 | A1 | 6/2002 | Carossino et al. | |
| 2006/0032638 | A1 | 2/2006 | Giroux et al. | |
| 2010/0012320 | A1 | 1/2010 | Vail et al. | |

OTHER PUBLICATIONS

Office Action issue for Norwegian Patent Application No. 20160752 dated Jun. 11, 2017, 5 pages.

* cited by examiner

BOTTOM HOLE ASSEMBLY RETRIEVAL FOR CASING-WHILE-DRILLING OPERATIONS USING A TETHERED FLOAT VALVE

FIELD OF THE DISCLOSURE

The present disclosure relates generally to casing-while-drilling ("CWD") operations and, more specifically, to systems and methodologies that use a tethered float valve to retrieve the bottom hole assembly during a CWD operation.

BACKGROUND

In the drilling of oil and gas wells, CWD is a method of forming a wellbore with a drill bit attached to the same string of casing that will line the wellbore. In other words, rather than to run a drill bit on smaller diameter drill string, the bit is run at the end of larger diameter casing that will remain in the wellbore and be cemented therein. Because the same string of casing transports the bit and lines the wellbore, no separate trip out of or into the wellbore is necessary between the forming of the borehole and the lining of the borehole. CWD is especially useful in certain situations where an operator wants to drill and line a wellbore as quickly as possible in is order to minimize the time the borehole remains unlined and subject to collapse or the detrimental effects of pressure anomalies.

After drilling to a predetermined depth, the drill bit is destroyed or retrieved from the borehole and, thereafter, a cementing operation is performed. The cementing operation fills the annular space between the outer diameter of a casing and the borehole wall with cement. The cement will set the casing in the wellbore and facilitate the isolation of production zones and fluids at different depths within the wellbore.

A number of conventional methods exist by which to retrieve the bottom hole assembly. For example, one method involves destroying the drill bit using an explosive charge and thereafter removing the bottom hole assembly. Another involves deploying a retrieval tool down the wellbore that latches onto the bottom hole assembly and thereby removes it. However, the disadvantage of such methods is that they are dangerous, complicated and time-consuming.

Accordingly, there is a need in the art for a more safe, practical and efficient technique in which to retrieval a bottom hole assembly during a CWD operation.

DESCRIPTION OF ILLUSTRATIVE EMBODIMENTS

Illustrative embodiments and related methodologies of the present disclosure are described below as they might be employed in a system or methodology which uses a tethered float valve to retrieve a CWD bottom hole assembly. In the interest of clarity, not all features of an actual implementation or methodology are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methodologies of the disclosure will become apparent from consideration of the following description and drawings.

As described herein, illustrative embodiments of the present disclosure use a tethered float valve to retrieve a bottom hole assembly in a CWD operation. In general, an illustrative bottom hole assembly includes an elongated drum connected to the drill pipe extending from the surface. One or more casing joints forming a string are secured around the drum using a release mechanism which releases the casing joints after a predetermined amount of force is applied to the drum. A one-way float valve is connected above the drum to facilitate retrieval of the bottom hole assembly, and a drilling assembly is connected to the lower end of the drum to drill the wellbore. A tether (wireline, for example) is wrapped around the drum in the annular area between the drum and casing. One end of the tether is attached to the float valve, while the second end is connected to drum.

During operation of this generalized embodiment, the bottom hole assembly is deployed downhole. Fluid is pumped down the drill string, through the float valve and elongated drum, and to the drill bit to facilitate drilling operations. Once the desired depth has been reached, the release mechanism is activated to thereby release the drum from the casing joints. Thereafter, fluid is reverse circulated down the wellbore around the casing joints and back up the bottom hole assembly, where it encounters the one-way check valve. Here, since the float valve prevents reverse circulation through its bore, the fluid forces the float valve uphole. As the float valve moves uphole, it remains connected to the drum via the tether which continues to unwrap from around the drum. Once the float valve reaches the surface, the bottom hole assembly may then be pulled uphole using the tether. Thereafter, the casing joints may be cemented in place. These and other features/advantages of the present disclosure will be described in detail below.

Figure 1:
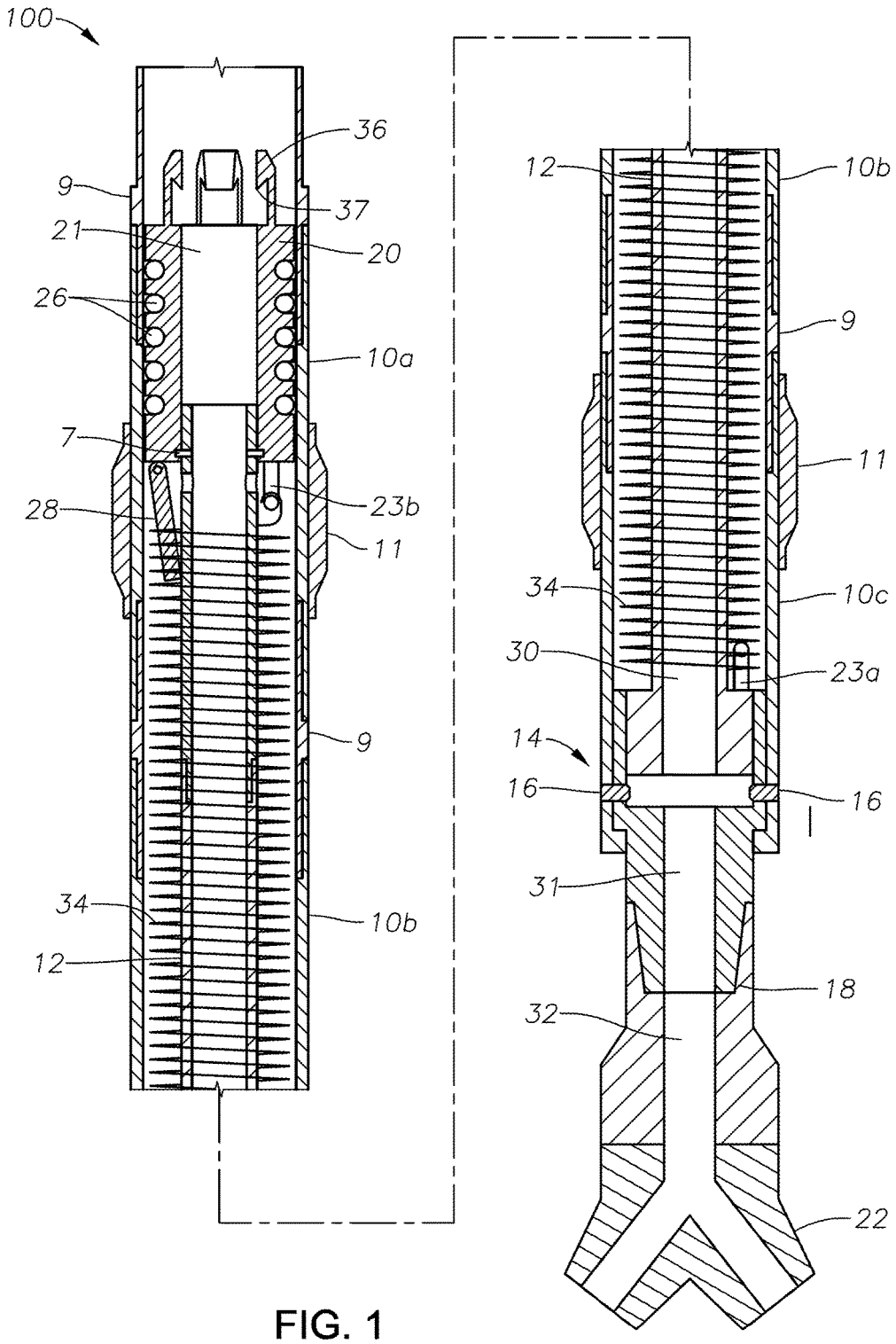
FIG. 1 illustrates a bottom hole assembly used in a CWD operation according to certain illustrative embodiments of the present disclosure.

FIG. 1 illustrates a bottom hole assembly used in a CWD operation according to certain illustrative embodiments of the present disclosure. Bottom hole assembly ("BHA") 100 includes casing joints 10A-C forming a casing string, which may be connected to one another using, for example, American Petroleum Institute ("API") connections or other suitable connectors 9. Although seven casing joints are illustrative in this example, more or less casing joints may be used in alternate embodiments. One or more centralizers and/or stabilizers 11 may be positioned along the outer diameter of casings 10, as necessary. BHA 100 also includes an elongated drum 12 positioned within casing joints 10. Drum 12 is secured to casing joints 10 using a release mechanism 14 positioned at the lower end of drum 12.

In this illustrative embodiment, release mechanism 14 is a shear pin assembly having shear pins 16 extending out radially around release mechanism 14 and into the body a casing joint 10C. Release mechanism 14 may connect to drum 12 via threaded or other suitable connections. The lower end of release mechanism 14 forms a threaded connection 18 used to connect various other BHA components such as, for example, a drilling assembly 22. Release mechanism 14 is thus adapted to selectively release drum 12 from casing joints 10 upon application of force necessary to shear pins 16. Alternatively, release mechanism 14 may be, for example, one way biting slips which engage casing 10 if pushed from above, while retracting if pushed from below to allow movement of BHA 100. Additionally, other release mechanisms may include pressure operated slips, as will be understood by those ordinarily skilled in the art having the benefit of this disclosure.

Although illustrated in simplistic form, drilling assembly 22 may take a variety of forms including, for example, a drill bit 15 and drilling motor that is operated by fluid pressure. Release mechanism 14 allows the transfer of torque and weight to the bit 15 necessary for drilling operations. As described above, when a sufficient weight on bit 15 is exceeded, shear pins 16 shear and thus release casing 10 from BHA 100. In certain illustrative embodiments, BHA 100 may be a logging-while-drilling ("LWD") or a measurement-while-drilling ("MWD") assembly. In such embodiments, BHA 100 may be used to sense and communicate properties such as drilling temperatures, pressures, azimuth and inclination and would be configured to readily transmit data to a surface location, as will be understood by those ordinarily skilled in the art having the benefit of this disclosure. In yet other embodiments, various other BHA components (stabilizers, collars, reamers, rotary steering, etc.) may also be positioned along BHA 100 as desired for a given operation.

A float valve 20 is positioned within an upper end of casing joints 10 (joint 10A) such that drum 12 extends into the lower end of valve 20. In alternate embodiments, however, there may be a gap between float valve 20 and drum 12. Float valve 20 may be, for example, a one-way Baker-type float valve, although other valves may be used. Float valve 20 contains a bore 21 extending therethrough. A series of friction balls 26 are positioned around the outer diameter of float valve 20 in order to reduce the contact surface between casing 10 and valve 20. Although not shown, one or more seals may seal on the surface of float valve 20 to prevent fluid flow between casing joints 10 and the outer diameter of float valve 20. As shown in FIG. 1, float valve 20 is secured to drum 12 via shear pins 7 extending between drum 12 and bore 21. In other illustrative embodiments, float valve 20 may also rest on a shoulder along the inner diameter of casing joint 10A. When deployed downhole, flapper 28 of float valve 20 is opened and drum 12 is inserted therein, thus sealing drum 12 against bore 21 to prevent fluid leakage. As such, this illustrative embodiment of float valve 20 only allows fluid flow down through bore 21. During drilling operations of BHA 100 as described below, fluid is allowed to flow through bores 21 and 30, as well as bore 32 of drilling assembly 22. However, during reverse circulation, flapper 28 is allowed to close (after shear pins 7 are sheared), thus creating the force necessary to force float valve 20 to the surface.

A spool of tether 34 is wrapped around drum 12 to facilitate retrieval of BHA 100 (after release of casing 10) from the wellbore. Tether 34 may be any variety of tethers suitable to support the weight of retrieved BHA 100, such as, for example, a wireline, chains, belts, nylon ropes or cables. Nevertheless, a first end of tether 34 is connected to hook 23*a* of drum 12, while a second end of tether 34 is connected to hook 23*b* float valve 20. Connections other than hooks may be used to connect to tether 34, as will be understood by those ordinarily skilled in the art having the benefit of this disclosure. The tether 34 is spooled over drum 12 in multiple layers to is provide enough length whereby float valve 20 may be forced to the surface while still connected to drum 12. Drum 12 may be a single elongated member or may be comprised of multiple elongated members connected together (via threaded connections, for example) in order to provide the necessary length to wrap tether 34.

In the illustrative embodiment of FIG. 1, tether 34 is isolated from fluid flowing through bore 30 during drilling in order to prevent damage to tether 34. The isolation is achieved because drum 12 is positioned along bore 21 of float valve 20. As will be described in more detail below, when it is desired to retrieve BHA 100 from the wellbore, float valve 20 is forced uphole using reverse circulation. While this is occurring, tether 34 unwraps from around drum 12 until valve 20 reaches the surface. Thereafter, in certain embodiments, drum 12 and drilling assembly 22 is pulled uphole using tether 34.

Figure 4:
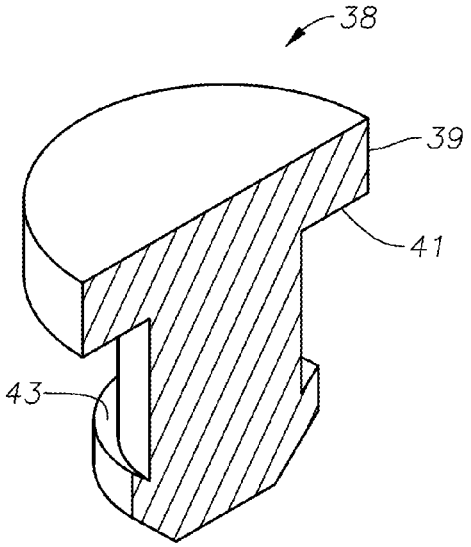
FIG. 4 illustrates a valve catcher used to retrieve a bottom hole assembly according to an illustrative embodiment of the present disclosure.

Additionally, certain illustrative embodiments of BHA 100 include a latch 36 connected to the upper end of float valve 20. Latch 36 extends from the body of valve 20 and comprises a hooked distal end 37. As briefly mentioned above, during retrieval of BHA 100, float valve 20 and latch 36 are forced uphole where latch 36 is caught by a suitable valve catch mechanism at the surface. FIG. 4 illustrates a valve catcher according to an illustrative embodiment of the present disclosure. Valve catcher 38 includes a body 39 forming a shoulder 41 at one end, and a hooked distal end 43 which mates with hooked distal end 37 of valve 20. In certain illustrative embodiments, valve catcher 38 may be positioned at the surface and placed in a crossover sub which is secured using a threaded connection to the casing sub. Valve catcher 38 may extend to the length where the annulus of casing 10 is connected to the flow line and shale shakers. Therefore, during retrieval operations, float valve 20 is force uphole until latch 36 encounters valve catcher 38 where it is caught using mating hooks 37,43. Thereafter, drum 12 and drilling assembly 22 are pulled uphole using tether 34.

Figure 2A:
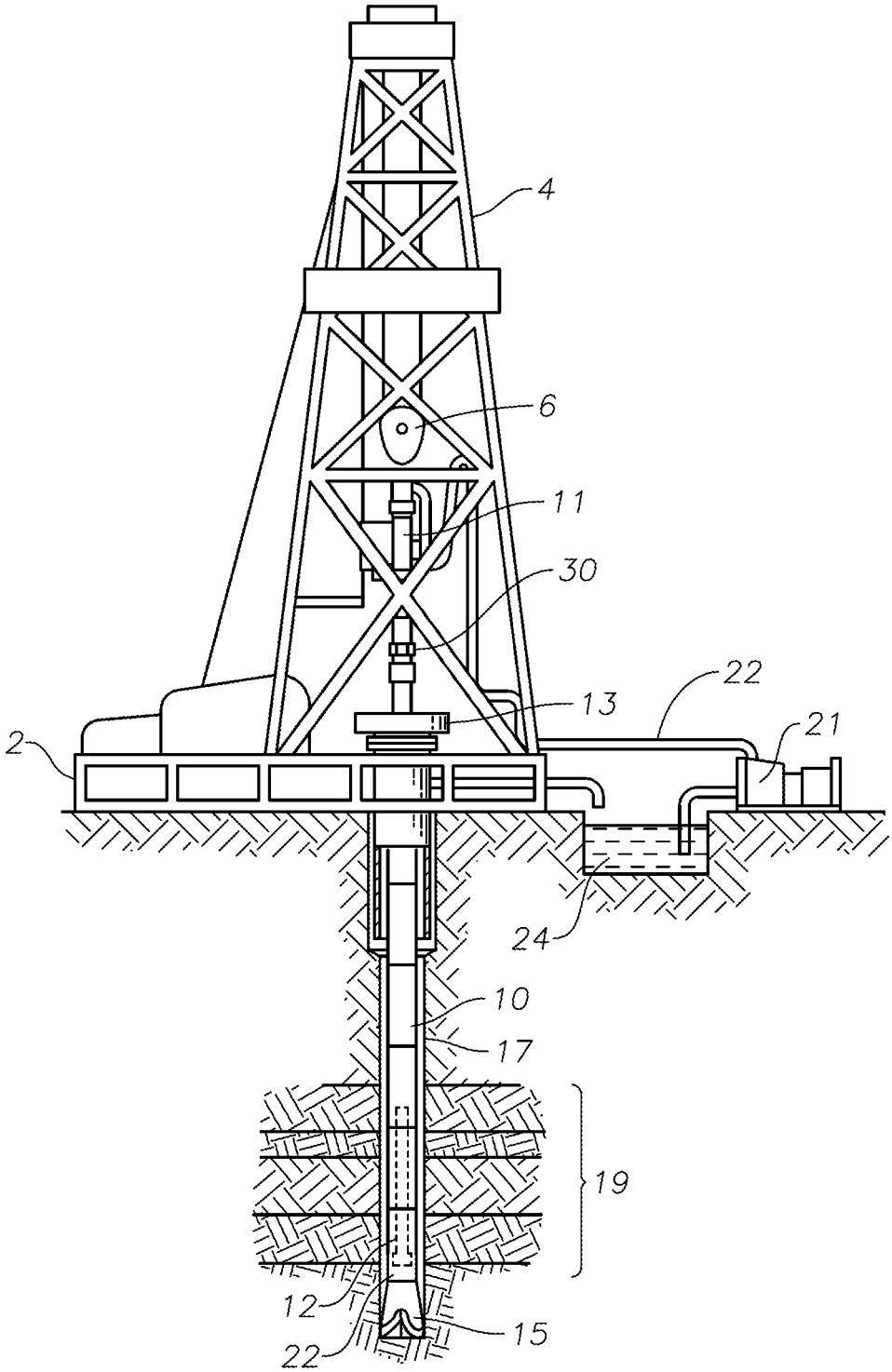
FIG. 2A illustrates a bottom hole assembly extending along a wellbore, according to certain illustrative embodiments of the present disclosure.
Figure 2B:
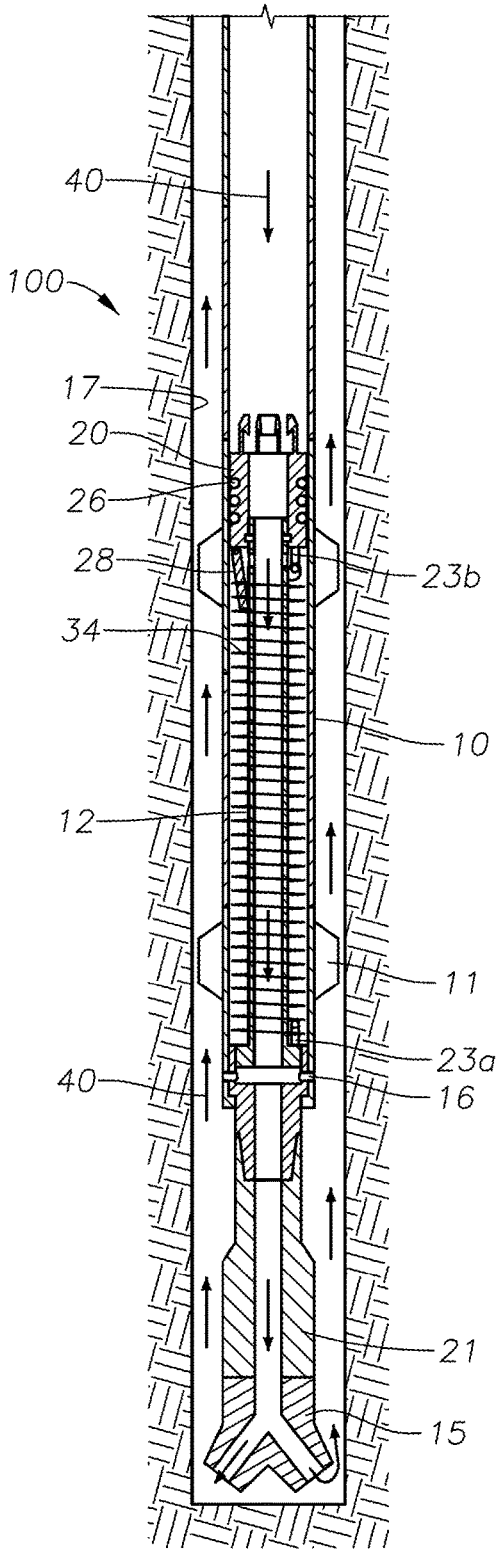
FIGS. 2B, 2C and 2D illustrate a bottom hole assembly at various stages of a CWD operation, according to certain illustrative embodiments of the present disclosure.
Figure 2C:
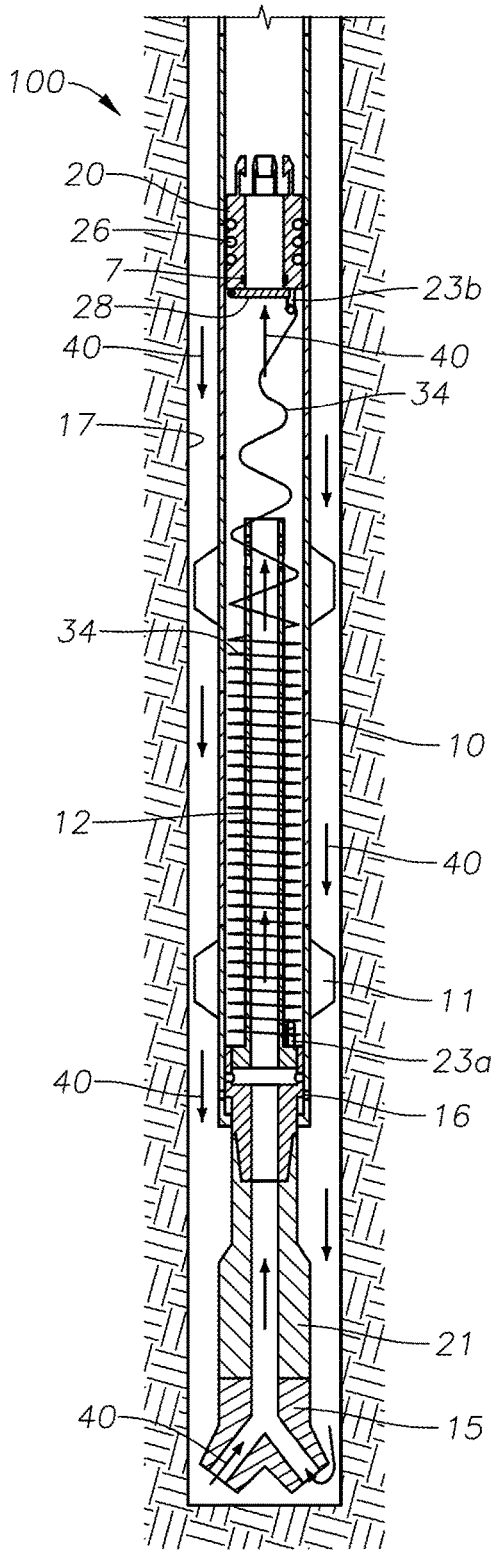
Figure 2D:
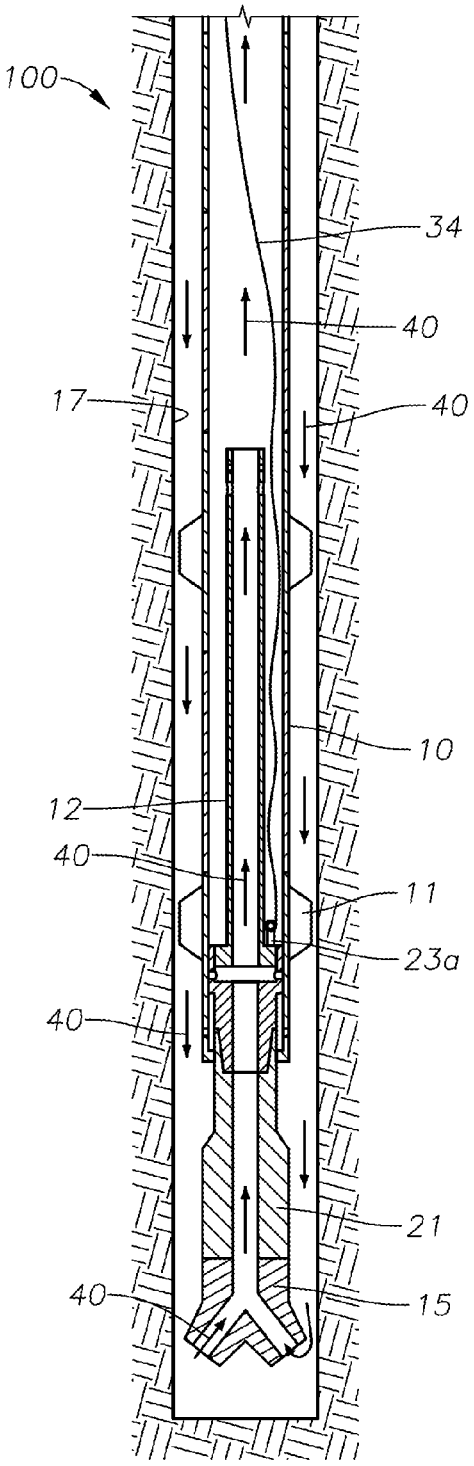

FIG. 2A illustrates a BHA extending along a wellbore, according to certain illustrative embodiments of the present disclosure. FIGS. 2B, 2C and 2D illustrate a BHA 200 at various stages of a CWD operation, according to certain illustrative embodiments of the present disclosure. BHA 200 is embodied as an MWD assembly; however, it may be embodied as, for example, an LWD assembly or other desired drilling assembly in alternate embodiments. Additionally, BHA 200 is somewhat similar to the BHA 100 and, therefore, may be best understood with reference thereto, where like numerals indicate like elements. Referring to FIG. 2A, a drilling platform 2 is equipped with a derrick 4 that supports a hoist 6 for raising and lowering a casing string comprised of casing joints 10. Hoist 6 suspends a top drive 11 suitable for rotating casing string 10 and lowering it through well head 13. Connected to the lower end of casing string 10 is a drill assembly 22. As the drill bit of drilling assembly 22 rotates, it creates a wellbore 17 that passes through various formations 19. A pump 21 circulates drilling fluid (also referred to as "mud") through a supply pipe 22 to top drive 11, down through the interior of casing string 10, through the nozzles in the drill bit 15 (in order to operate the drill bit), back to the surface via the annulus around casing string 10, and into a retention pit 24. The drilling fluid transports cuttings from the borehole into pit 24 and aids in maintaining the integrity of wellbore 17. Various materials can be used for drilling fluid, including, but not limited to, a salt-water based conductive mud.

With reference to FIGS. 2A and 2B, an illustrative CWD operation using BHA 200 will now be described. To begin, BHA 200 is deployed downhole where drilling assembly 22 begins drilling wellbore 17. As drilling is being conducted, pump 21 introduces pressurized drilling fluid, indicated by arrows 40, into casing string 10, where it then flows down through the bore of valve catcher 36 and bore 21 of float valve 20. As previously described, flapper 28 is in the open position already since drum 12 is inserted into bore 21. The drilling fluid then continues to flow down bore 30 of drum 12, bore 31 of release mechanism 14, bore 32 of drilling assembly 22, and then out of the nozzles of the drill bit 15, where it serves to operate, lubricate and cool the drill bit 15. During pumping, as previously described, tether 34 is isolated from drilling fluid 40 as it flows through bore 30. However, in other embodiments, fluid 40 may be allowed to surround drum 12 to remove the pressure differential between various components. Nevertheless, the used drilling fluid 40 mixed with cuttings dislodged by the drill bit 15 of assembly 22 then flows upwards through wellbore 17 along the annular passage external to casing string 10. This annular passage is sealed at surface level to permit collection of the used drilling fluid 40 and recycling, as will be understood by those ordinarily skilled in the art having the benefit of this disclosure.

Drilling continues in this manner until BHA 200 reaches the desired depth along wellbore 17. Once reached, wellbore 17 is ready to be cased using casing string 10. To perform this operation in this illustrative methodology, weight is applied on casing string 10 and drilling assembly 22 until the release mechanism 14 (shear pins 16, for example) is sheared, thus releasing drum 12 from casing string 10. During this time, the joints of casing string 10 may be held in place using slips on the derrick floor or may remain hanging by the hoisting system, for example. Once casing joints 10 are released via shearing of pins 16 (as shown in FIG. 2C), fluid 40 (drilling mud, for example) is reverse circulated down the annular passage, up the nozzles of the bit 15 of drilling assembly 22, and up bores 31, 32 and 30, thus causing float valve 20 to begin moving uphole due to fluid pressure.

As float valve 20 moves upward, shear pins 7 shear and drum 12 is removed from bore 21, thus allowing flapper 28 to close. In certain embodiments, seals may be positioned between drum 12 and float valve 20 to ensure pins 7 shear. Nevertheless, since flapper 28 is biased in the closed position, reverse circulating fluid 40 is prevented from flowing past flapper 28, thus forcing float valve 20 up casing string 10. During upward movement, friction balls 26 allow easier movement of float valve 28 up casing string 10. In addition, the seal(s) (not shown) surrounding the outer diameter of valve 20 prevents fluid 40 from flowing around float valve 20, so that the full upward force of the reverse circulated fluid 40 pushes valve 20 uphole.

In certain alternate methodologies, reverse circulation may be conducted before casing joints 10 are released from drum 12. Here, reverse circulation is first used to force float valve 20 uphole, as previously described, while tether 34 is still connected to drum 12. Thereafter, shear mechanism 14 is sheared to separate drum 12 from casing joints 10. Once released, drum 12 and drilling assembly 22 may then be retrieved uphole using tether 34.

Referring to FIG. 2D, continued reverse circulation of fluid 40 results in float valve 20 being forced further uphole. As float valve 20 is forced uphole, tether 34 remains attached to valve 20 at one end via hook 23*b* and drum 12 at the other end via hook 23*a*. As such, tether 34 begins unwrapping from around drum 12 as float valve 20 moves further uphole. Once float valve 20 reaches the surface (not shown), tether 34 is used to pull, or retrieve, drum 12, release mechanism 14, and drilling assembly 22 up through casing string 10 and to the surface, while casing string 10 remains downhole at the desired depth. The pulling may occur in a variety of ways, such as, for example, similar to the way wireline tools are pulled uphole using a rotating drum. In an alternative embodiment, valve catcher 38 (not shown) is positioned at the surface to catch float valve 20 via latch 36, thus causing float valve 20 to hang off valve catcher 38. Once drum 34, release mechanism 14 and drilling assembly 22 have been retrieved from wellbore 17, casing string 10 may be cemented in place using any desired cementing technique.

Figure 3:
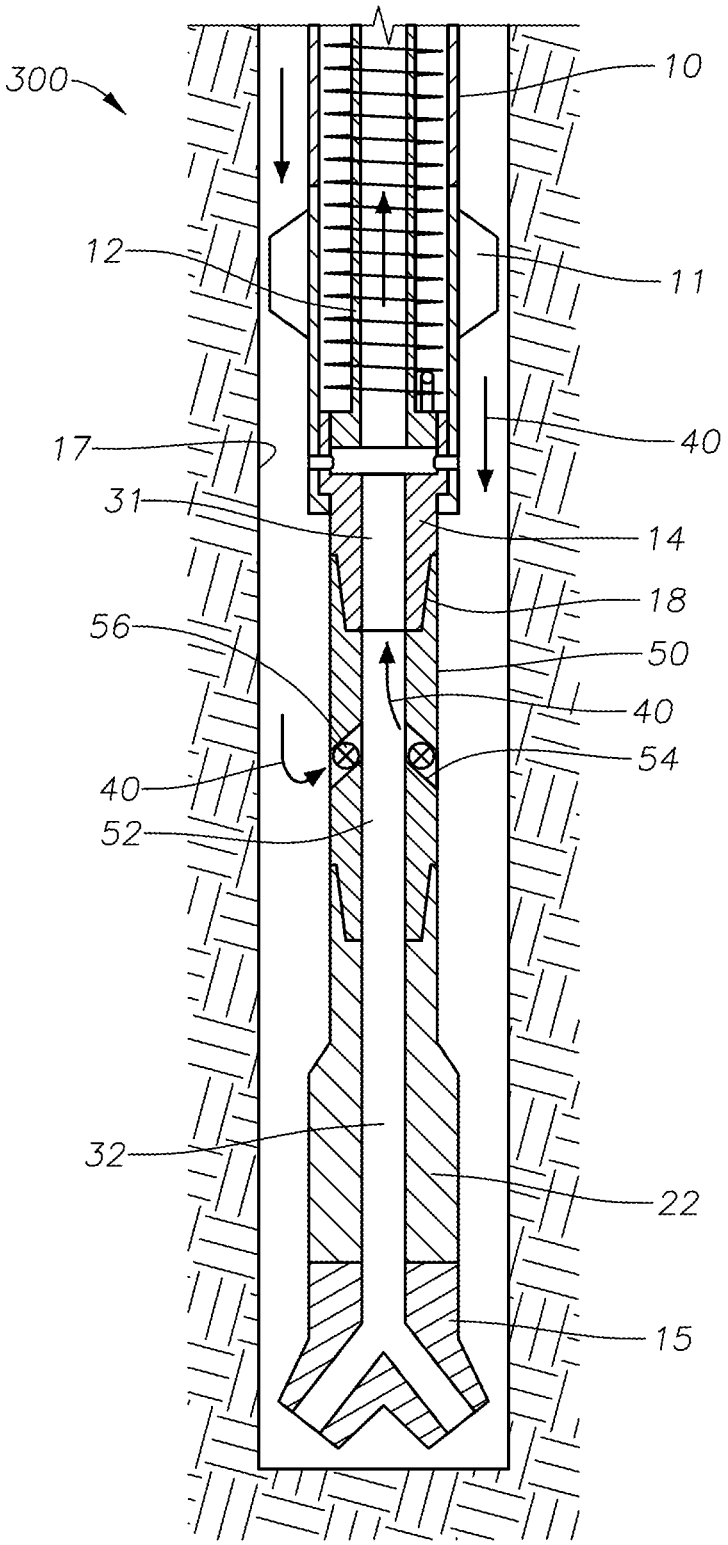
FIG. 3 illustrates an exploded sectional view of a bottom hole assembly having a reverse circulation sub, according to certain illustrative embodiments of the present disclosure.

FIG. 3 illustrates an exploded sectional view of a BHA 300, according to certain illustrative embodiments of the present disclosure. BHA 300 is somewhat similar to bottom hole assemblies 100 and 200 and, therefore, may be best understood with reference thereto, where like numerals indicate like elements. Thus, for simplicity, only the contrasting aspects of BHA 300 are shown, as the remaining components remain the same as shown in FIGS. 1 and 2A-2D. During some CWD operations, it may be difficult to reverse circulate through the drill bit 15 because the cuttings may clog the bit nozzles, or the well may collapse and prevent reverse circulation from the bit end. Therefore, unlike previously embodiments, BHA 300 includes a reverse circulation sub 50 positioned between drum 12 and drilling assembly 22, to thereby permit reverse circulation in such situations.

Reverse circulation sub 50 may be connected to the lower end of release mechanism 14 and the upper end of drilling assembly 22 using a variety of methods, including, for example, API threaded connections. A primary bore 52 extends from the upper to lower end of reverse circulation sub 50 to allow fluid flow therethrough in the forward and reverse directions. One or more secondary bores 54 extend from primary bore 52 radially through the sidewall of reverse circulation sub 50 to thereby provide fluid communication to the annulus (i.e., annular area) of wellbore 17. A one-way valve 56 is positioned along secondary bore(s) 54 to only allow fluid flow in a reverse direction up bore 52 as shown. Therefore, during normal drilling operations, fluid 40 is allowed to flow downhole through bores 30, 31, 52, and 32, then out the drill bit nozzles of drilling assembly 22. During forward flow of fluid 40, one-way valves 56 prevent the flow of fluid 40 through secondary bore(s) 54.

When it is desired to retrieve BHA 300 (except for casing 10) from wellbore 17, drum 12 is released from casing joints 10 as previously described. Thereafter, fluid 40 is reverse circulated down the annular area around casing joints 10 and up through secondary bore(s) 54 and valve 56, where fluid 40 then flows up primary bore 52 and up drum 12, where it forces float valve 20 uphole as previously described. In one illustrative embodiment, a ball may be dropped down BHA 300 into bore 32 of drilling assembly 22 before reverse circulation begins. As a result, when fluid 40 is reverse circulated up secondary bores 54, it is prevented from flow down and out of the nozzles of the drill bit 15 by the ball. Accordingly, using BHA 300, drilling assembly 22 would not be needed to perform reverse circulation.

Figure 5:
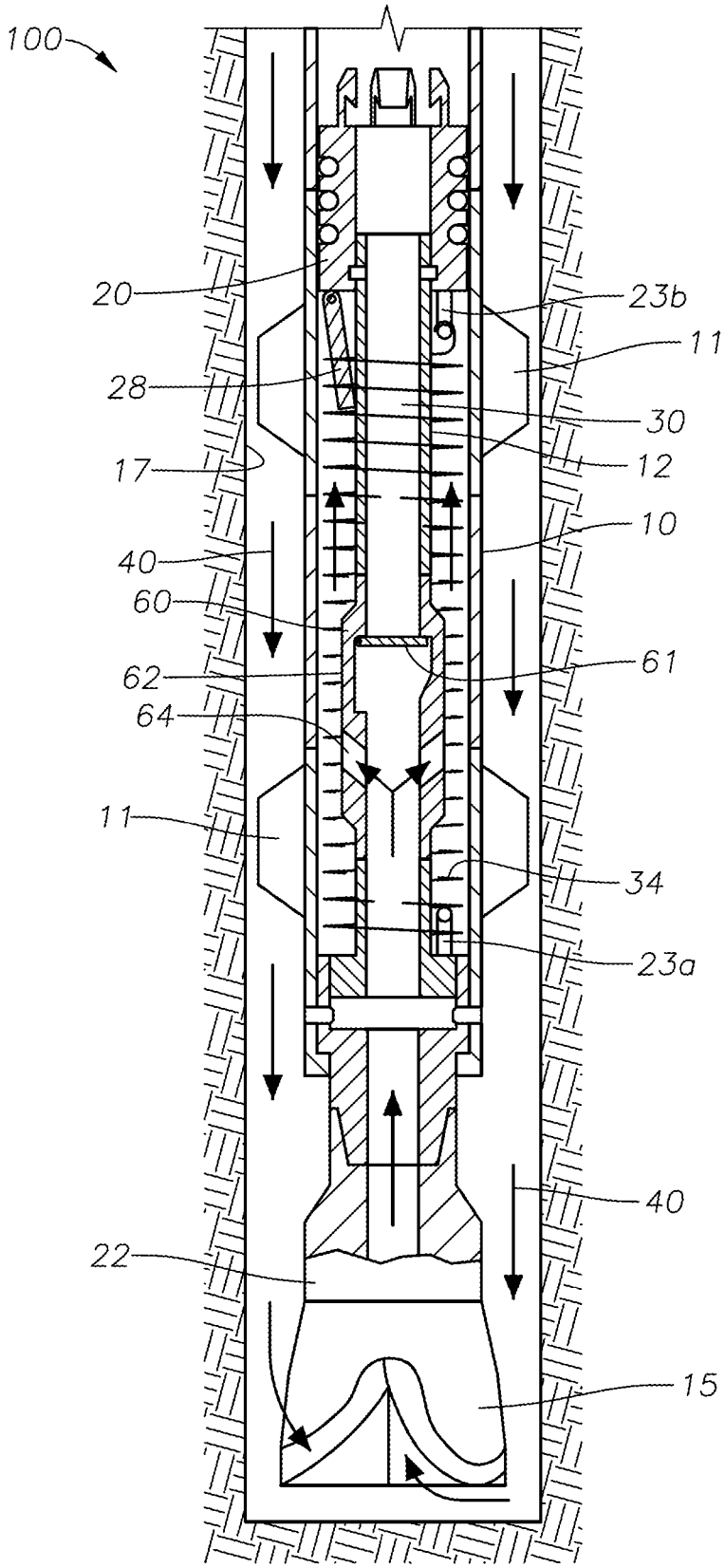
FIG. 5 illustrates a sectional view of a bottom hole assembly during reverse circulation, according to certain alternative illustrative embodiments of the present disclosure.

FIG. 5 illustrates a sectional view of a BHA 500 during reverse circulation, according to certain illustrative embodiments of the present disclosure. BHA 500 is somewhat similar to bottom hole assemblies 100, 200 and 300 and, therefore, may be best understood with reference thereto, where like numerals indicate like elements. Thus, for simplicity, only the contrasting aspects of BHA 500 are shown, as the remaining components may remain the same as shown in previous embodiments. However, BHA 500 includes a flapper valve 60 (float valve, for example) and reverse flow diverting sub 62 positioned between drum 12 and release mechanism 14. Flapper valve 60 may form part of flow diverting sub 62 or may be a separate component. Additionally, flapper valve 60 and flow diverting sub 62 may be connected along BHA 500 using any suitable technique.

During operation of BHA 500, fluid is pumped down float valve 20 and drum 12 as previously described. Flapper valve 60 includes a flapper 61 which is forced into the open position during drilling operations, thus allowing operation of drilling assembly 22. Flow diverting sub 62 includes bores 64 extending through its sidewalls through which fluid 40 may flow outwardly from sub 62. Although not shown, check valves may be positioned along bores 64 in order to prevent fluid from flowing into sub 62. Nevertheless, when it is desired to retrieve BHA 500, fluid 40 is again reverse circulated down the annular area around casing 10 and back up the drill bit 15 or reverse circulation sub 50 (not shown). Since flapper 61 is now in the closed position, fluid 40 is forced out of bores 64 as shown, thus forcing float valve 20 upward as previously described.

In an alternative embodiment, a variety of other one-way type restrictors may be used in place of flapper valve 60, such as, for example, a drop ball restrictor as will be understood by those ordinarily skilled in the art having the benefit of this disclosure.

In yet another illustrative embodiment, a memory device and associated processing circuitry may be positioned along bottom hole assemblies 100,200,300 in order to process and/or store downhole data. For example, such circuitry may be positioned within float valve 20, and be comprised of at least one processor and a non-transitory and computer-readable storage, all interconnected via a system bus. The data may be transmitted uphole using wired or wireless methodologies, or the data may be downloaded once float valve 20 reaches the surface. Software instructions executable by the processor for implementing downhole data processing or other functions may be stored in local storage or some other computer-readable medium. It will also be recognized that the same software instructions may also be loaded into the storage from a CD-ROM or other appropriate storage media via wired or wireless methods.

Moreover, those ordinarily skilled in the art will appreciate that various aspects of the disclosure may be practiced with a variety of computer-system configurations, including hand-held devices, multiprocessor systems, microprocessor-based or programmable-consumer electronics, minicomputers, mainframe computers, and the like. Any number of computer-systems and computer networks are acceptable for use with the present disclosure. The disclosure may be practiced in distributed-computing environments where tasks are performed by remote-processing devices that are linked through a communications network. In a distributed-computing environment, program modules may be located in both local and remote computer-storage media including memory storage devices. The present disclosure may therefore, be implemented in connection with various hardware, software or a combination thereof in a computer system or other processing system.

Accordingly, through use of the illustrative embodiments of the present disclosure, non-productive tripping time may be reduced in a practical and efficient manner. In addition to CWD applications, embodiments of the present disclosure may be applied to completions, seismic survey, wireline and perforation operations. In well completions, liners can be installed directly without having a separate trip for the liner installation. With slight modifications, such as making a valve catcher part of the liner, a setting retrievable tool can be used for installation of liner hangers during a single trip for drilling the target depth and installing the liners. The cementation of the liners and casings may also be conducted in the same trip.

In addition, perforating gun forming part of the BHA may perforate the casing. Here, the electric signal can be transmitted to the perforating gun through the wireline from the surface. Similarly, data can be received from the logs. Sensors forming part of the BHA can transmit data to the surface through the wireline. Thus, the need for lowering the wire line tools to take the is logs is eliminated. Also, CBL (Cement Bond Log) and VDL (Variable Density log) logs related to cementing can be taken immediately after the cementing is done. Moreover, the use of above mentioned embodiments can be used for Cross Well Tomography seismic applications and receiving the signals on real time basis to the surface from nearby wells.

Additionally, the bottom hole assemblies may be modified for transporting additional battery units downhole. Here, the uppermost portion of the assembly may be the float valve followed by a battery unit, followed by the drum. The wireline in this example would pass through the battery unit. After catching the float valve during reverse circulation, a new battery unit is attached to the float valve and both are deployed back downhole. The new battery unit, which is typically a Li Ion battery cell mounted on a sub, has either a male or female electric connector. The new battery unit attaches itself to the other battery unit, as each battery unit will have the opposite male or female electric connector necessary to make the connections. In yet other embodiments, features of the bottom hole assemblies may be used as a fishing tool, as will be understood by those ordinarily skilled in the art having the benefit of this disclosure.

Embodiments described herein further relate to any one or more of the following paragraphs:

1. A bottom hole assembly for use in a casing-while-drilling operation, the assembly comprising one or more casing joints forming a casing string; an elongated drum secured along the casing string, the drum having a release mechanism to release the drum from the casing string; a tether wrapped around the drum; and a float valve positioned above the drum, wherein a first end of the tether is connected to the drum and a second end of the tether is connected to the float valve, thus allowing the float valve to be forced up a wellbore while still connected to the drum via the tether.

2. A bottom hole assembly as defined in paragraph 1, further comprising a drilling assembly positioned below the drum.

3. A bottom hole assembly as defined in any of paragraphs 1-2, wherein the tether is a wireline.

4. A bottom hole assembly as defined in any of paragraphs 1-3, wherein the float valve comprises a latch at an upper end of the float valve.

5. A bottom hole assembly as defined in any of paragraphs 1-4, further comprising a memory device positioned within the float valve to store downhole data.

6. A bottom hole assembly as defined in any of paragraphs 1-5, wherein the release mechanism is a shear pin assembly.

7. A bottom hole assembly as defined in any of paragraphs 1-6, further comprising a reverse circulation sub positioned between the drum and drilling assembly.

8. A bottom hole assembly as defined in any of paragraphs 1-7, wherein the reverse circulation sub comprises a primary bore extending from an upper end of the reverse circulation sub to a lower end of the reverse circulation sub, the upper end of the bore being in fluid communication with the drum; a secondary bore extending from the primary bore and through a sidewall of the reverse circulation sub to thereby provide fluid communication between the primary bore and an annulus of the wellbore; and a one-way valve positioned along the secondary bore to allow reverse circulation up the primary bore.

9. A method for performing a casing-while-drilling operation, the method comprising drilling a wellbore with a bottom hole assembly comprising: one or more casing joints forming a casing string; an elongated drum secured within the casing string; a tether wrapped around the drum and connected to the drum; a float valve positioned above the drum, the float valve being connected to the tether; and a drilling assembly positioned below the drum; reaching a desired depth within the wellbore; releasing the drum from the casing string; forcing the float valve up the wellbore, the float valve remaining attached to the drum via the tether; and retrieving the drum and drilling assembly from the wellbore using the tether.

10. A method as defined in paragraph 9, wherein drilling the wellbore comprises pumping drilling fluid down the bottom hole assembly, through the drum, and out of a drill bit of the drilling assembly, wherein the tether wrapped around the drum remains isolated from the drilling fluid.

11. A method as defined in any of paragraphs 9-10, wherein releasing the drum from the casing string comprises shearing a release mechanism that secures the drum to the casing string.

12. A method as defined in any of paragraphs 9-11, wherein forcing the float valve up the wellbore comprises: reverse circulating fluid up the drum to thereby force the float valve up the wellbore; and catching the float valve at a surface location using a valve catcher, wherein the drum and drilling assembly are pulled from the wellbore using the tether.

13. A method as defined in any of paragraphs 9-12, wherein reverse circulating the fluid further comprises reverse circulating the fluid through a drill bit of the drilling assembly and into the drum.

14. A method as defined in any of paragraphs 9-13, wherein reverse circulating the fluid further comprises reverse circulating the fluid through a reverse circulation sub and into the drum, the reverse circulation sub being positioned between the drum and drilling assembly.

15. A method as defined in any of paragraphs 9-14, further comprising storing downhole data in a memory device positioned within the float valve.

16. A method for performing a casing-while-drilling operation, the method comprising deploying a bottom hole assembly into a wellbore, the bottom hole assembly comprising: one or more casing joints forming a casing string; a drum secured within the casing string; a float valve positioned above the drum; and a tether coupling the drum to the float valve; releasing the drum from the casing string; forcing the float valve up the wellbore, the float valve remaining attached to the drum via the tether; and retrieving the drum and drilling assembly from the wellbore using the tether.

17. A method as defined in paragraph 16, wherein forcing the float valve up the wellbore comprises reverse circulating up the drum.

18. A method as defined in any of paragraphs 16-17, wherein reverse circulating up the drum further comprises: reverse circulating through a bit of the drilling assembly attached to the drum; or reverse circulating through a reverse circulation sub positioned between the drum and drilling assembly.

19. A method as defined in any of paragraphs 16-18, wherein releasing the drum from the casing string comprises shearing a release mechanism connecting the drum to the casing string.

20. A method as defined in any of paragraphs 16-20, wherein forcing the float valve up the wellbore comprises catching the float valve at a surface location using a valve catcher.

The foregoing disclosure may repeat reference numerals and/or letters in the various examples. This repetition is for the purpose of simplicity and clarity and does not in itself dictate a relationship between the various embodiments and/or configurations discussed. Further, is spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures. For example, if the apparatus in the figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Although various embodiments and methodologies have been shown and described, the disclosure is not limited to such embodiments and methodologies and will be understood to include all modifications and variations as would be apparent to one skilled in the art. Therefore, it should be understood that the disclosure is not intended to be limited to the particular forms disclosed. Rather, the intention is to cover all modifications, equivalents and alternatives falling within the spirit and scope of the disclosure as defined by the appended claims.

What is claimed is:

1. A bottom hole assembly for use in a downhole operation, the assembly comprising:

one or more tubing joints forming a downhole string;

a drum releasably secured to the string; and a tether coupling the drum to a float valve.

2. The bottom hole assembly as defined in claim 1, further comprising a drilling assembly connected to the drum.

3. The bottom hole assembly as defined in claim 1, wherein the tether is a wireline.

4. The bottom hole assembly as defined in claim 1, wherein the float valve comprises a latch at an upper end of the float valve.

5. The bottom hole assembly as defined in claim 1, further comprising a memory device positioned within the float valve.

6. The bottom hole assembly as defined in claim 1, further comprising a shear pin assembly that releasably secures the drum to the string.

7. The bottom hole assembly as defined in claim 2, further comprising a reverse circulation sub positioned between the drum and drilling assembly.

8. The bottom hole assembly as defined in claim 7, wherein the reverse circulation sub comprises: a primary bore extending from an upper end of the reverse circulation sub to a lower end of the reverse circulation sub, the upper end of the bore being in fluid communication with the drum;

a secondary bore extending from the primary bore and through a sidewall of the reverse circulation sub to thereby provide fluid communication between the primary bore and the wellbore; and a one-way valve positioned along the secondary bore to allow reverse circulation up the primary bore.

9. A method for performing a downhole operation, the method comprising:

drilling a wellbore with a bottom hole assembly having a tubing string coupled to a drilling assembly;

reaching a depth within the wellbore;

releasing the drilling assembly from the tubing string; and retrieving the drilling assembly from the wellbore using a tether by forcing a float valve up the wellbore, the float valve connected to the tether.

10. The method as defined in claim 9, wherein drilling the wellbore comprises pumping drilling fluid down the bottom hole assembly and out of a drill bit of the drilling assembly, wherein the tether remains isolated from the drilling fluid.

11. The method as defined in claim 9, wherein releasing the drilling assembly from the tubing string comprises shearing a release mechanism.

12. The method as defined in claim 9, wherein forcing the float valve up the wellbore comprises reverse circulating fluid up the drilling assembly.

13. The method as defined in claim 9, further comprising storing downhole data in a memory device positioned within the float valve.

14. A method for performing a downhole operation, the method comprising:

deploying a bottom hole assembly into a wellbore, the bottom hole assembly comprising:

one or more tubing joints forming a downhole string;

a drum positioned along the string;

a float valve; and a tether coupling the drum to the float valve;

forcing the float valve up the wellbore; and retrieving the drum from the wellbore using the tether.

15. The method as defined in claim 14, wherein forcing the float valve up the wellbore comprises reverse circulating the drum up the wellbore.

16. The method as defined in claim 15, wherein reverse circulating up the drum further comprises reverse circulating through a drilling assembly attached to the drum.

17. The method as defined in claim 15, wherein reverse circulating up the drum further comprises reverse circulating through a reverse circulation sub positioned between the drum and a drilling assembly.

18. The method as defined in claim 14, wherein releasing the drum from the string comprises shearing a release mechanism.

19. The method as defined in claim 14, wherein forcing the float valve up the wellbore comprises catching the float valve at a surface location.

* * * * *